US008734205B2

(12) United States Patent
Goldsmith et al.

(10) Patent No.: US 8,734,205 B2
(45) Date of Patent: May 27, 2014

(54) RIGID OR FLEXIBLE, MACRO-POROUS ABRASIVE ARTICLE

(75) Inventors: Paul S. Goldsmith, Stow, MA (US); Anthony C. Gaeta, Lockport, NY (US); James J. Manning, Braintree, MA (US); Kamran Khatami, East Greenwich, RI (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 815 days.

(21) Appl. No.: 12/637,533

(22) Filed: Dec. 14, 2009

(65) Prior Publication Data

US 2010/0159805 A1 Jun. 24, 2010

Related U.S. Application Data

(60) Provisional application No. 61/203,422, filed on Dec. 22, 2008.

(51) Int. Cl.
*B24B 1/00* (2006.01)

(52) U.S. Cl.
USPC ..... 451/41; 451/532; 451/533; 451/536

(58) Field of Classification Search
USPC ..... 451/41, 530, 532, 533, 536, 539, 544, 451/548
See application file for complete search history.

(56) References Cited

U.S. PATENT DOCUMENTS

| | | | | |
|---|---|---|---|---|
| 2,277,520 | A * | 3/1942 | Martin et al. | 51/293 |
| 4,918,874 | A | 4/1990 | Tiefenbach, Jr. | |
| 5,094,670 | A | 3/1992 | Imada | |
| 5,198,292 | A * | 3/1993 | Lerner et al. | 442/97 |
| 5,431,596 | A | 7/1995 | Akita | |
| 5,437,754 | A | 8/1995 | Calhoun | |

(Continued)

FOREIGN PATENT DOCUMENTS

| | | |
|---|---|---|
| CN | 1088506 | 6/1994 |
| CN | 101068656 | 11/2007 |

(Continued)

OTHER PUBLICATIONS

PCT/US2009/067914: Notification of Transmittal of the International Search Report and the Written Opinion of the International Searching Authority, or the Declaration dated Jul. 26, 2010.

(Continued)

*Primary Examiner* — Maurina Rachuba
(74) *Attorney, Agent, or Firm* — Joseph P. Sullivan; Abel Law Group, LLP

(57) ABSTRACT

A macro-porous abrasive article includes a spun lace substrate having a macro-porous structure and a coating. The coating is made of a resin binder and abrasive aggregates. The abrasive aggregates are formed from a composition of abrasive grit particles and a nanoparticle binder. The coating is at least partially embedded in the substrate. A method for making the macro-porous abrasive article includes combining abrasive aggregates of abrasive grit particles and a nanoparticle binder with a resin binder to form a slurry. The slurry is applied to a macro-porous support structure so that the slurry at least partially penetrates the substrate. The resin is then cured to bond the aggregate grains to the substrate.

20 Claims, 5 Drawing Sheets

(56) References Cited

U.S. PATENT DOCUMENTS

| | | | | |
|---|---|---|---|---|
| 5,667,541 | A | 9/1997 | Klun et al. | |
| 6,024,634 | A | 2/2000 | Hoglund et al. | |
| 6,197,076 | B1 | 3/2001 | Braunschweig et al. | |
| 6,790,126 | B2 * | 9/2004 | Wood et al. | 451/41 |
| 6,797,023 | B2 * | 9/2004 | Knapp et al. | 51/298 |
| 8,038,751 | B2 * | 10/2011 | Starling | 51/295 |
| 2002/0090891 | A1 * | 7/2002 | Adefris et al. | 451/28 |
| 2003/0213182 | A1 * | 11/2003 | Knapp et al. | 51/295 |
| 2004/0067649 | A1 | 4/2004 | Hellring et al. | |
| 2005/0223649 | A1 | 10/2005 | O'Gary et al. | |
| 2006/0046622 | A1 | 3/2006 | Prasad | |
| 2006/0260208 | A1 * | 11/2006 | Swei et al. | 51/295 |
| 2007/0066197 | A1 | 3/2007 | Woo et al. | |
| 2008/0172951 | A1 * | 7/2008 | Starling | 51/308 |

FOREIGN PATENT DOCUMENTS

| | | | |
|---|---|---|---|
| CN | 101267915 | | 9/2008 |
| EP | 1339531 | B1 | 8/2007 |
| JP | 10-202538 | A | 8/1998 |
| JP | 2003011068 | | 1/2003 |
| JP | 2003062754 | | 3/2003 |
| JP | 2003071729 | | 3/2003 |
| JP | 2005522341 | | 7/2005 |
| WO | WO 9201536 | A | 2/1992 |
| WO | 0238338 | A2 | 5/2002 |

OTHER PUBLICATIONS

PCT/US2009/067914: International Search Report dated Jul. 26, 2010.

PCT/US2009/067914: Written Opinion of the International Searching Authority dated Jul. 26, 2010.

PCT/US2009/067914: Notification Concerning Transmittal of International Preliminary Report on Patentability dated Jul. 7, 2011.

* cited by examiner

RIGID OR FLEXIBLE, MACRO-POROUS ABRASIVE ARTICLE

RELATED APPLICATION

This application claims the benefit of U.S. Provisional Application No. 61/203,422, filed on Dec. 22, 2008. The entire teachings of the above application are incorporated herein by reference.

BACKGROUND OF THE INVENTION

High performance abrasive particles for use in finishing and polishing include grit particles and composite particles. Grit particles are solid grains, while composite particles are formed from an aggregate of small primary grit particles bound together within a nanoparticle binder.

Conventionally, when grit particles are used to finish or polish a surface to a desired smoothness, the polishing process occurs in several polishing steps using abrasive grains of varying grit size. Each successive polishing step involves the use of grit particles of decreased size. The surface is first polished with a relatively coarse abrasive material and then polished again with a somewhat finer grit abrasive material. This process may be repeated several times, which each successive re-polishing being carried out with a progressively finer grit abrasive until the surface is polished to the desired degree of smoothness.

It has been found that use of composite particles offer the efficiency of achieving comparable surface smoothness in fewer steps, or in even only a single polishing step. It is believed that the primary particles, the nanoparticle binder, and the aggregate as a whole each achieve the steps of polishing necessary to obtain the final desired surface smoothness. Composite particles are therefore favored in applications requiring fast ultra-fine polishing.

Nevertheless, a need exists for an abrasive article and a method of polishing that achieves improved surface smoothness and longer product life.

SUMMARY OF THE INVENTION

In one aspect the invention is directed to a macro-porous abrasive article that includes a patterned non-woven spun lace substrate having a macro-porous structure and a coating. The coating is made of a resin binder and abrasive aggregates. The abrasive aggregates are formed from a composition of abrasive grit particles and nanoparticle binder. The coating is at least partially embedded into the substrate.

In another aspect, the invention is directed to a method of forming a macro-porous abrasive article. The method includes combining abrasive aggregates formed from abrasive grit particles in a nanoparticle binder with a resin binder to form a slurry. The slurry is then applied to a patterned non-woven spun lace substrate having a macro-porous structure so that the slurry at least partially penetrates the substrate. The resin is then cured to bond the aggregate grain to the substrate.

The present invention has many advantages. For example, the abrasive article of the invention includes a macroporous backing or substrate that removes substantially either dry or wet swarf from a workpiece during use. By doing so, "loading" or clogging that can occur is significantly reduced, thereby extending the cutting life of the abrasive article. Further, the abrasive article of the invention can be rigid, such as is particularly suitable for applications including drywall joint sanding, for example. The abrasive article, in another embodiment, can be flexible, and is suitable for applications such as ophthalmic lens finishing. Other applications, where either flexible or semi-rigid abrasive articles of the invention can be employed, are automotive clear coat finishing and automotive primer finishing.

DETAILED DESCRIPTION OF THE INVENTION

Figure 1:
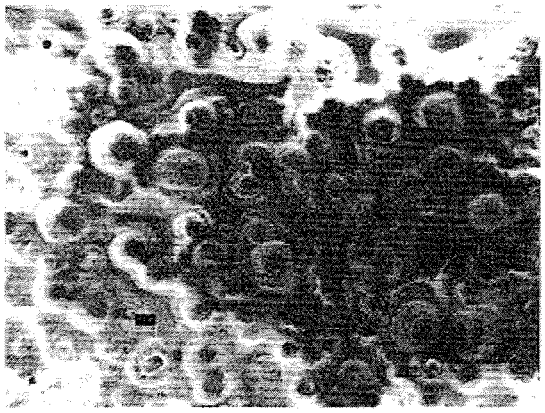
FIGS. 1-3 are photomicrographs taken with a scanning electron microscope showing abrasive aggregates including diamond grit combined with silica nanoparticles in a coating on a substrate.
Figure 2:
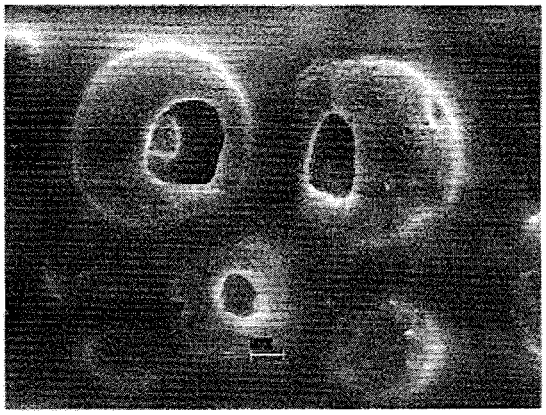
Figure 3:
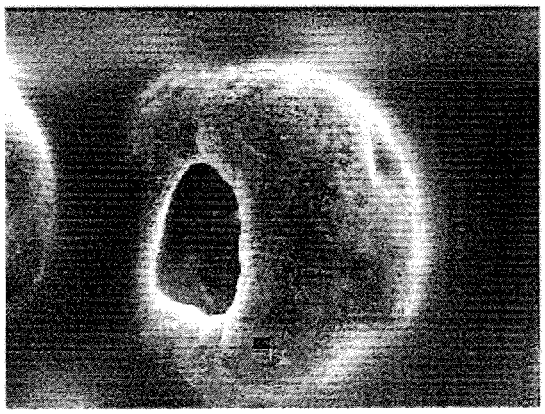

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention. The teachings of all patents, published applications and references cited herein are incorporated by reference in their entirety. Described in detail below are the components of various embodiments of the abrasive article of the invention.

The abrasive article of the invention includes a patterned macroporous substrate, a resin binder, and abrasive aggregates. The abrasive aggregates include abrasive grit particles and a nanoparticle binder.

Macroporous Substrate

In one embodiment, the macroporous substrate of the abrasive article of the invention is formed from fibers that have been bound to form a nonwoven web. The fibers can be interlocked by a suitable method known in the art, such as needle punching and hydro-entanglement. Hydro-entangled webs are also known as "spun lace." In some embodiments, the substrate can be hydro-entangled with a velour attachment system to create a composite substrate with lint free attachability to the polishing tooling. The fibers of the substrate can be continuous or staple fibers, monofilament or multifilament, and can be formed from various materials, including polymer fibers and plant fibers. In one embodiment, the fiber is a polyester fiber. Other materials that can be used include synthetic fibers such as polypropylene, polyethylene, nylon, rayon, steel, fiberglass, or natural fibers, such as cotton or wool. The fiber can be between about 100-2000 denier.

Figure 7:
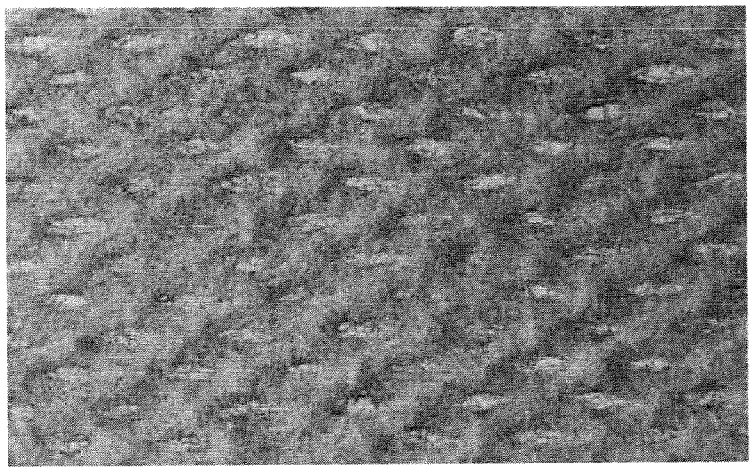
FIG. 7 is a drawing of a patterned macro-porous substrate.

The substrate material is preferably flexible and can have a thickness between about 300 micron and about 6 mm. The pattern of the substrate can vary, but should include macropores, such as those shown in FIG. 7. As used herein, the term "macroporous" means having a pore size between about 15 microns to about 3 mm. These macropores of the macroporous substrate not only reduce swarf accumulation during the polishing operation, but also allow the abrasive article to be compliant, so that it can conform to irregular sanded shapes. In addition, the macropores allow fluids and sanding swarf to flow through the web, preventing loading of the abrasive article.

Abrasive Aggregate Particles

As used herein, the term "aggregate" may be used to refer to a particle made of a plurality of smaller particles that have been combined in such a manner that it is relatively difficult to separate or disintegrate the aggregate particle into smaller particles by the application of pressure or agitation. This is in contrast to the term "agglomerate," which is used to refer to a particle made of a plurality of smaller particles which have been combined in such a manner that it is relatively easy to disintegrate into the smaller particles, such as by the application of pressure or hand agitation. Generally, agglomerates form spontaneously in slurry or in dispersion, while aggregates must be formed by a specific method, such as those described in U.S. Pat. No. 6,797,023 and U.S. patent application Ser. No. 12/018,589 entitled, "Coated Abrasive Products Containing Aggregates," of Starling, filed on Jan. 23, 2008, the teachings of which are incorporated herein in their entirety. The aggregates have a composite structure, including both abrasive grits that have a size within the microparticle range, and a nanoparticle binder that provides the matrix of the aggregate in which the abrasive grits are embedded or contained.

Typically, the aggregates are utilized in the abrasive material without notable post-formation heat treatment, such as calcining, sintering, or recrystallization, which alters the crystallite size, grain size, density, tensile strength, young's modulus, and the like of the aggregates. Such heat treatment processes are commonly carried out in ceramic processing to provide usable products, but are not utilized herein. Such heat treatment steps are generally carried out in excess of about 400° C., generally about 500° C. and above. Indeed, temperatures can easily range from about 800° C. to about 1200° C. and above for certain ceramic species.

Figure 4:
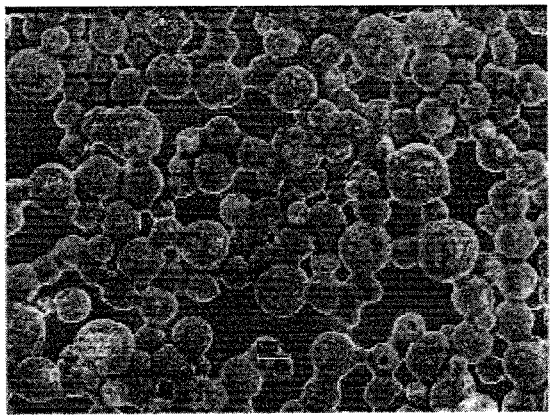
FIGS. 4-6 are photomicrographs taken with a scanning electron microscope showing abrasive aggregates including silicon carbide grit combined with silica nanoparticles in a coating on a substrate.
Figure 5:
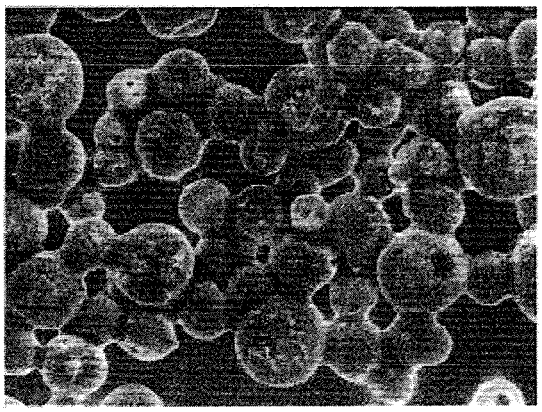
Figure 6:
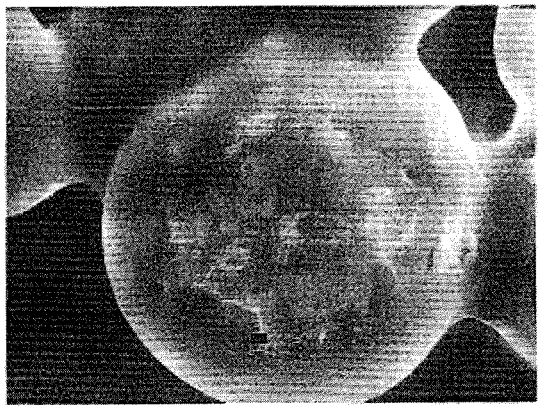

When viewed under magnification, the aggregates have a generally spheroidal shape, being characterized as rounded or spherical as seen in the scanning electron micrographs of FIGS. 4-6. In some instances, however, the aggregates may be observed to have a void near the center of the aggregate and thus exhibit a more toroid or torus-like shape as seen in the scanning electron micrographs of FIGS. 1-3. Individual particles of the abrasive grit material, such diamond grit, may be observed to be dispersed over the surface of the aggregates and within the interior thereof, with relatively few instance of the individual grit particles clumping together on the surface of the aggregate. It is noted that FIGS. 1-6 show dispersed, individual aggregates that are bound together in a resin binder system.

The size and size range of the aggregates may be adjusted and may depend on many factors, including the composition of the mixture and, if a spray dryer is used in aggregate formation, the spray dryer feed rate. For example, abrasive aggregates of sizes including those of approximately 20 microns, 35 microns, 40 microns, and 45 microns can be produced using a spray dryer. These aggregates can include abrasive grit particles ranging from about 5 to about 8 microns.

Further study of the abrasive aggregates has revealed that certain spheroids are hollow, while others are essentially filled with grain and/or nanoparticle binder. Hollow particles can be analogized to thick-shelled racquet balls, having a wall thickness within a range of about 0.08 to about 0.4 times the average particle size of the aggregates. Process parameters and compositional parameters can be modified to effect different wall thicknesses. In some embodiments, the abrasive agglomerates are those described in U.S. Pat. No. 6,797,023 and U.S. patent application Ser. No. 12/018,589 entitled, "Coated Abrasive Products Containing Aggregates," of Starling, filed on Jan. 23, 2008, the teachings of which are incorporated herein in their entirety.

Abrasive Grit Particles

The abrasive grit particles that form the aggregate composite particle generally have a Mohs hardness of greater than about 3, and preferably from about 3 to about 10. For particular applications, the abrasive grit particles have a Mohs hardness not less than about 5, 6, 7, 8, or 9. The abrasive grit particles are generally believed to serve as the primary active grinding or polishing agent in the abrasive aggregates. Examples of suitable abrasive compositions include non-metallic, inorganic solids such as carbides, oxides, nitrides and certain carbonaceous materials. Oxides include silicon oxide (such as quartz, cristobalite and glassy forms), cerium oxide, zirconium oxide, aluminum oxide. Carbides and nitrides include, but are not limited to, silicon carbide, aluminum, boron nitride (including cubic boron nitride), titanium carbide, titanium nitride, silicon nitride. Carbonaceous materials include diamond, which broadly includes synthetic diamond, diamond-like carbon, and related carbonaceous materials such as fullerite and aggregate diamond nanorods. Materials may also include a wide range of naturally occurring mined minerals, such as garnet, cristobalite, quartz, corundum, feldspar, by way of example. Certain embodiments of the present disclosure, take advantage of diamond, silicon carbide, aluminum oxide, and/or cerium oxide materials, with diamond being shown to be notably effective. In addition, those of skill will appreciate that various other compositions possessing the desired hardness characteristics may be used as abrasive grit particles in the abrasive aggregates of the present disclosure. In addition, mixtures of two or more different abrasive grit particles can be used in the same aggregates. Silicon carbide has been found to be particularly effective as a grit particle for use in the present abrasive article. In particular, the silicon carbide is preferably about 21% by weight bonded, but can range between about 10% and about 80% by weight bonded.

As should be understood from the foregoing description, a wide variety of abrasive grit particles may be utilized in embodiments. Of the foregoing, cubic boron nitride and diamond are considered "superabrasive" particles, and have found widespread commercial use for specialized machining operations, including highly critical polishing operations. Further, the abrasive grit particles may be treated so as to form a metallurgical coating on the individual particles prior to incorporation into the aggregates. The superabrasive grits are particularly suitable for coating. Typical metallurgical coatings include nickel, titanium, copper, silver and alloys and mixtures thereof.

In general, the size of the abrasive grit particles lies in the microparticle range. As used herein, the term "microparticle," may be used to refer to a particle having an average particle size of from about 0.1 microns to about 50 microns, preferably not less than about 0.2 microns, about 0.5 microns, or about 0.75 microns, and not greater than about 20 microns, such as not greater than about 10 microns. Particular embodiments have an average particle size from about 0.5 microns to about 10 microns. The size of the abrasive grit particles can vary upon the type of grit particles being used. For example, diamond grit particles can have the size of about 0.5 to about 2 microns, silicon carbide grit particles can have the size of about 3 to about 8 microns, and aluminum oxide grit particles can have a size of about 3 to about 5 microns.

It should be noted that the abrasive grit particles can be formed of abrasive aggregates of smaller particles such as abrasive aggregate nanoparticles, though more commonly the abrasive grits are formed of single particles within the microparticle range. As used herein, the term "nanoparticle," may be used to refer to a particle having an average particle size of from about 5 nm to about 150 nm, typically less than about 100 nm, 80 nm, 60 nm, 50 nm, or less than about 50 nm. For instance, a plurality of nano-sized diamond particles may be aggregated together to provide a microparticle of diamond grit. The size of the abrasive grit particles can vary depending upon the type of grit particles being used.

The abrasive grit particles may, in general, constitute between about 0.1% to about 85% of the aggregates. The aggregates more preferably include between about 10% to about 50% by weight of the abrasive grit particles.

The abrasive aggregates may be formed using a single size of abrasive grit particle, the size of the grit particle and the resultant aggregates both being tailored to the desired polishing application. In the alternative, mixtures of two or more differently sized abrasive grit particles may be used in combination to form abrasive aggregates having advantageous characteristics attributable to each of the grit particle sizes.

Nanoparticle Binder

The abrasive aggregates according to the present disclosure also include a nanoparticle binder material as stated above. The nanoparticle binder generally forms a continuous matrix phase that functions to form and hold the abrasive grit particles together within the abrasive aggregates in the nature of a binder. In this respect, it should be noted that the nanoparticle binder, while forming a continuous matrix phase, is itself generally made up of individually identifiable nanoparticles that are in intimate contact, interlocked and, to a certain extent, bonded with each other. However, due to the green, unfired state of the thus formed aggregates, the individual nanoparticles are generally not fused together to form grains, as in the case of a sintered ceramic material. As used herein, description of nanoparticle binder extends to one or multiple species of binders.

The nanoparticle binder material may comprise very fine ceramic and carbonaceous particles such as nano-sized silicon dioxide in a liquid colloid or suspension (known as colloidal silica). Nanoparticle binder materials may also include, but are not limited to, colloidal alumina, nano-sized cerium oxide, nano-sized diamond, and mixtures thereof. Colloidal silica is preferred for use as the nanoparticle binder in certain embodiments of the present disclosure. For example, commercially available nanoparticle binders that have been used successfully include the colloidal silica solutions BINDZEL 2040 BINDZIL 2040 (available from Eka Chemicals Inc. of Marietta, Ga.) and NEXSIL 20 (available from Nyacol Nano Technologies, Inc. of Ashland, Mass.).

The abrasive aggregates also can include another material which serves primarily as a plasticizer, also known as a dispersant, to promote dispersion of the abrasive grit within the aggregates. Due to the low processing temperatures used, the plasticizer is believed to remain in the aggregates, and has been quantified as remaining by thermal gravimetric analysis (TGA). The plasticizer might also assist in holding together the grit particles and nanoparticle binder material in an aggregate when the mixture is spray-dried.

Plasticizers include both organic and inorganic materials, including surfactants and other surface tension modifying species. Particular embodiments make use of organic species, such as polymers and monomers. In an exemplary embodiment, the plasticizer is a polyol. For example, the polyol may be a monomeric polyol or may be a polymeric polyol. An exemplary monomeric polyol includes 1,2-propanediol; 1,4-propanediol; ethylene glycol; glycerin; pentaerythritol; sugar alcohols such as malitol, sorbitol, isomalt, or any combination thereof; or any combination thereof. An exemplary polymeric polyol includes polyethylene glycol; polypropylene glycol; poly (tetramethylene ether) glycol; polyethylene oxide; polypropylene oxide; a reaction product of glycerin and propylene oxide, ethylene oxide, or a combination thereof; a reaction product of a diol and a dicarboxylic acid or its derivative; a natural oil polyol; or any combination thereof. In an example, the polyol may be a polyester polyol, such as reaction products of a diol and a dicarboxylic acid or its derivative. In another example, the polyol is a polyether polyol, such as polyethylene glycol, polypropylene glycol, polyethylene oxide, polypropylene oxide, or a reaction product of glycerin and propylene oxide or ethylene oxide. In particular, the plasticizer includes polyethylene glycol (PEG).

Forming the Abrasive Article

The coating of the abrasive article is initially a slurry of abrasive aggregates and a binder used to adhere the aggregates onto a surface of a substrate. The binder is preferably a polymeric resin binder. Suitable polymeric resin materials include polyesters, epoxy resins, polyurethanes, polyamides, polyacrylates, polymethacrylates, polyvinyl chlorides, polyethylene, polysiloxane, silicones, cellulose acetates, nitrocellulose, natural rubber, starch, shellac, and mixtures thereof. The polymeric resin may be cured by heat or other radiation. Most preferably, the resin is a U.V. curable acrylate resin.

In addition to the aggregates and binder, the slurry generally also includes a solvent such as water or an organic solvent and a polymeric resin material. The slurry may additionally comprise other ingredients to form a binder system designed to bond the aggregate grains onto a substrate. The slurry composition is thoroughly mixed using, for example, a high shear mixer.

The aggregates, resin and optional additives are combined together to form the slurry, and the slurry is coated onto the substrate to at least partially penetrate the substrate. The slurry is preferably applied to the substrate using a blade spreader to form a coating. Alternatively, the slurry coating may be applied using slot die, roll, transfer, gravure, or reverse gravure coating methods. As the substrate is fed under the blade spreader at a desired coat speed, the aggregate grain slurry is applied to the substrate in the desired thickness.

The abrasive article can be flexible, semi-rigid, or rigid, depending on how much the aggregate coating penetrates the substrate. Partial penetration yields a flexible abrasive article, while complete penetration of the coating yields a rigid or semi-rigid abrasive article. As used herein, the term "rigid," means deformable or bendable to as small as about a 3 inch radius. As used herein, the term "semi-rigid," means deformable or bendable to about as small as a 1 inch radius. As used herein, the term "flexible" means deformable or bendable to as small as about a ¼ inch radius.

Optionally, additional abrasive particles can be added over the aggregate coating using various grain application methods, such as gravity application, slurry, electrostatic coating, or electrostatic spray. In addition, an antiloading or dispersing agent can be added to the abrasive article to further minimize the accumulation of swarf.

The coated substrate is then cured by heating or radiation to harden the resin and bond the aggregate grains to the substrate. In one embodiment, the coated substrate is heated to a temperature of between about 100° C. and about 250° C. during this curing process. In another embodiment of the present disclosure, it is preferred that the curing step be carried at a temperature of less than about 200° C. In yet another embodiment, the coating is cured by U.V. radiation.

Once the resin is cured and the aggregate abrasive grains are bonded to the substrate, and the coated substrate may be used for a variety of stock removal, finishing, and polishing applications. A work surface can be abraded by applying the finished abrasive product in an abrading motion to remove a portion of a work surface. A description of example embodiments of the invention follows.

EXAMPLES

Two types of backing, PET (polyethylene terepthalate) film and a macroporous substrate (PGI Spun Lace M059 scrim) were tested for abrasion performance on identical AAA 1.25" test panels. The PET film-backed and macroporous substrate-backed abrasive articles included the same coating, which included a U.V. acrylate binder resin mixed with abrasive aggregates formed from silicon carbide grit particles and a nanoparticle binder resin.

Figure 8:
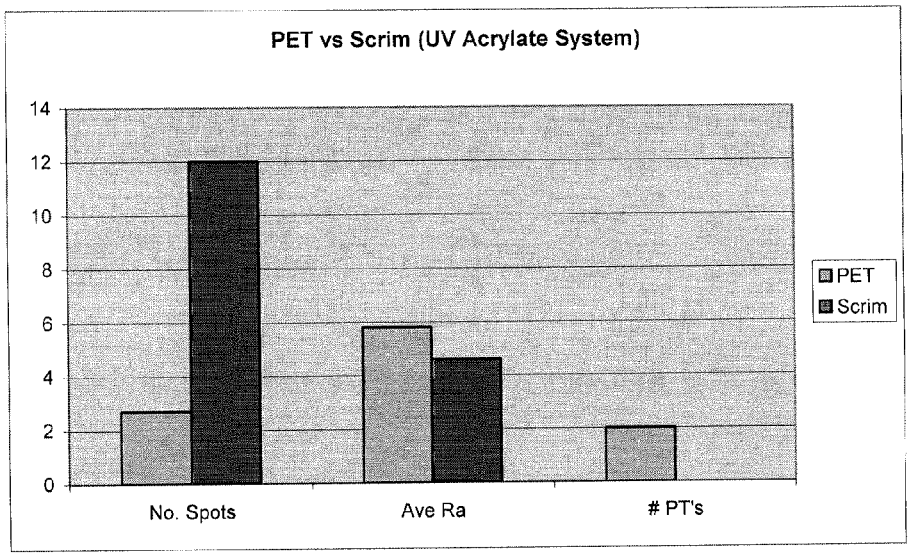
FIG. 8 shows a performance comparison of two different backings for the abrasive article.

Performance results, such as the number of spots before exhaustion ("No. Spots"), average surface roughness ("Ra") and number of pigtails ("#PT's") were recorded and are shown in the bar chart in FIG. 8. The number of spots before exhaustion indicates the useful life duration of the test article. An abrasive test sample is used to abrade and remove surface defects on as many surface spots as possible before surface defects are no longer removed; the greater number of spots before exhaustion, the longer the useful life of the test article. Surface roughness is measured by a surface profilometer, in this case, the Mahr Perthometer M2 (Manufactured by Mahr GmbH Göttingen). A smooth surface is desirable. Pig-tails are deep spiral shaped scratches formed by the abrasive article during abrasion, and their presence is undesirable. The table indicates that UV acrylate slurry coatings on the macroporous substrate (PGI Spun Lace M059 scrim) perform significantly better than those on the PET film, as the scrim exhibited greater number of spots before exhaustion, less surface roughness, and absence of pig-tails.

As indicated in FIG. 8, macroporous substrate backing exhibits superior grinding performance in comparison to PET film backing in an abrasive aggregate system. This can also be observed by way of the maximum surface roughness after grinding, "Rmax." Table 1 below provides maximum surface roughness values for test abrasive articles similar to those described above.

TABLE 1

Comparison of Rmax for PET film and Scrim backings

| Backing | Rmax (n1) | Rmax (n2) | Rmax (n3) | Average |
|---|---|---|---|---|
| PET Film | 79 | 163 | 179 | 140 |
| Scrim (PGI Spun Lace M059) | 66 | 66 | 66 | 66 |

Figure 9:
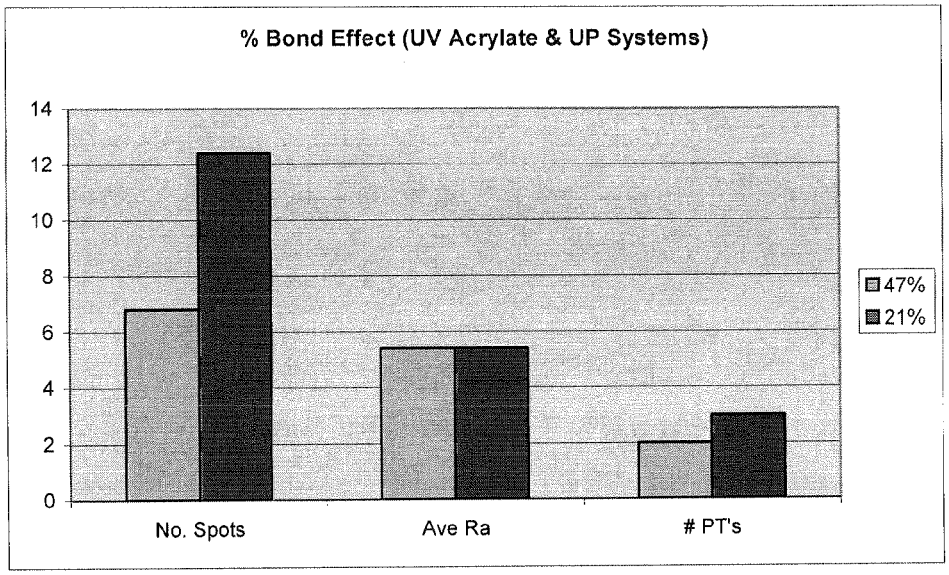
FIG. 9 shows a performance comparison of two different degrees of silicon carbide bonding in the abrasive grit particles.

For aggregates containing silicon carbide abrasive grit particles, two different degrees of bonding were also tested. The first abrasive article tested had silicon carbide grit particles that were 21% bonded. The second abrasive article tested had silicon carbide grit particles that were 47% bonded. In the bar chart of FIG. 9, the 21% bonded silicon carbide is shown to give an advantage in the total number of spots.

While this invention has been particularly shown and described with references to example embodiments thereof, it will be understood by those skilled in the art that various changes in form and details may be made therein without departing from the scope of the invention encompassed by the appended claims.

What is claimed is:

1. A macro-porous abrasive article, comprising:

a) a non-woven substrate comprising hydro-entangled fibers having a macro-porous structure including macropores having a pore size between about 15 microns to about 3 mm; and b) a coating on the macroporous substrate, the coating including a binder and green, unfired abrasive aggregates having a generally spheroidal or toroidal shape that are formed from a composition of abrasive grit particles and a nanoparticle binder, wherein the coating is at least partially embedded in the macroporous substrate.

2. The abrasive article of claim 1, wherein the article is flexible.

3. The abrasive article of claim 1, wherein the article is rigid or semi-rigid.

4. The abrasive article of claim 1, wherein the coating is fully embedded in the substrate.

5. The abrasive article of claim 1, further comprising additional abrasive particles over the coating.

6. The abrasive article of claim 1, further comprising an anti-loading/dispersing agent.

7. The abrasive article of claim 1, wherein the binder is an ultra violet light curable acrylate.

8. The abrasive article of claim 1, wherein the green, unfired aggregates are essentially filled.

9. The abrasive article of claim 8, wherein the green, unfired aggregates comprise about 21% by weight bond.

10. The abrasive article of claim 1, wherein the macroporous substrate is patterned.

11. A method of forming a macro-porous abrasive article, comprising the steps of:

a) combining abrasive aggregates with a resin binder to form a slurry, wherein the abrasive aggregates are green, unfired abrasive aggregates having a generally spheroidal or toroidal shape that are formed from a composition of abrasive grit particles and a nanoparticle binder;

b) applying the slurry to a non-woven substrate comprising hydro-entangled fibers having a macro-porous structure to at least partially penetrate the substrate, wherein the macro-porous structure includes macropores having a pore size between about 15 microns to about 3 mm; and c) curing the resin to bond the aggregate grains to the substrate.

12. The method of claim 11, wherein the slurry fully penetrates the substrate.

13. The method of claim 11, wherein the slurry is applied to the substrate by gravure coating, roll coating, or transfer coating.

14. The method of claim 11, further comprising the step of applying a grain coating after applying the slurry to the substrate.

15. The method of claim 14, wherein the grain coating is applied by gravity, slurry, electrostatic coating or electrostatic spray.

16. The method of claim 11, wherein the resin binder is an acrylate.

17. The method of claim 16, wherein the acrylate resin binder is cured by ultra violet light.

18. The abrasive article of claim 11, wherein the macroporous substrate is patterned.

19. The abrasive article of claim 11, wherein the macroporous substrate is non-woven.

20. A method for abrading a work surface, comprising applying an abrasive product in an abrading motion to remove a portion of the work surface, the abrasive product including:

a) a nonwoven substrate comprising hydro-entangled fibers having a macro-porous structure including macropores having a pore size between about 15 microns to about 3 mm; and a coating on the macroporous substrate, the coating including a binder and green, unfired abrasive aggregates having a generally spheroidal or toroidal shape that are formed from a composition of abrasive grit particles and a nanoparticle binder, wherein the coating is at least partially embedded in the macroporous substrate.

* * * * *